US005734137A

United States Patent [19]

Wakefield

[11] Patent Number: 5,734,137

[45] Date of Patent: Mar. 31, 1998

[54] UNIVERSAL KEYPAD ASSEMBLY

[75] Inventor: I. Nelson Wakefield, Cary, N.C.

[73] Assignee: Ericsson, Inc., Research Triangle Park, N.C.

[21] Appl. No.: 681,311

[22] Filed: Jul. 22, 1996

[51] Int. Cl.[6] ..... H01H 13/70

[52] U.S. Cl. ..... 200/5 A; 200/512; 200/313

[58] Field of Search ..... 200/5 A, 5 R, 200/512–517, 86 R, 308–317

[56] References Cited

U.S. PATENT DOCUMENTS

| | | | |
|---|---|---|---|
| 3,600,428 | 8/1971 | Leposavic | 200/5 A |
| 4,066,860 | 1/1978 | Kawasaki | 200/5 A |
| 4,180,711 | 12/1979 | Hirata et al. | 200/5 A |
| 4,293,754 | 10/1981 | Komaki | 200/5 A X |
| 4,311,893 | 1/1982 | Tsuchiya et al. | 200/5 A X |
| 4,314,115 | 2/1982 | Sado et al. | 200/5 A |
| 4,460,810 | 7/1984 | Fukukura | 200/5 A |
| 4,609,792 | 9/1986 | Levasseur | 200/5 A |
| 4,640,994 | 2/1987 | Komaki | 200/5 A |
| 4,694,126 | 9/1987 | Aiken, Jr. et al. | 200/5 A |
| 4,847,452 | 7/1989 | Inaba | 200/5 A |
| 5,149,923 | 9/1992 | Demeo | 200/5 A |

*Primary Examiner*—J. R. Scott
*Attorney, Agent, or Firm*—Jenkens & Gilchrist P.C.

[57] ABSTRACT

A pair of electrical contacts are provided on a lower surface of each key in a keypad assembly. When a key is depressed, the contacts are brought into electrical communication with a common conductive surface such that an electrical circuit is completed between a discrete pair of terminals. The arrangement, number, and configuration of keys can be changed without modifying the decoding logic and supporting circuitry of a keypad-operated instrument.

7 Claims, 2 Drawing Sheets

UNIVERSAL KEYPAD ASSEMBLY

BACKGROUND OF THE INVENTION

1. Technical Field

This invention relates generally to a keypad assembly, and more particularly to a keypad assembly in which each of the keys have a pair of contacts through which a discrete electrical circuit is established in response to depressing the key.

2. History of Related Art

Keypads are commonly used in telecommunication instruments such as cellular phones, integrated pager/telephones, and mobile radios. Typically, the keypad is incorporated in a handset containing both a speaker and a microphone, and frequently, a liquid crystal display (LCD) screen. Heretofore, multiple versions of the same basic handset require multiple printed wiring boards (PWB) to support different keypad arrangement or configurations. Multiple printed wiring boards increase the number of parts that are required to be carried in stock, and contribute to higher initial costs for a handset. Also, additional time is required to develop each printed wiring board to support each new handset arrangement. Currently, a new handset requires a new printed wiring board layout, a new frame, and a new keypad.

The present invention is directed to overcoming the problems set forth above. It is desirable to have a keypad assembly which requires only modification of the keys and the frame supporting the keys for varying handset arrangements. It is also desirable to have such a keypad assembly in which the discrete electrical circuits established to identify specific keys are not dependent upon a wiring board specifically designed for each key arrangement.

SUMMARY OF THE INVENTION

In accordance with one aspect of the present invention, a keypad assembly includes a frame, a base disposed in a fixed relationship with the frame and has an electrically conductive surface disposed thereon, and a plurality of keys that are movably supported within the frame. Each of the keys have a pair of spaced apart electrical contacts disposed on a lower surface of the keys which are movable between a first position at which the pair of contacts are spaced from the electrically conductive surface of the base, to a second position at which the contacts are disposed in common electrical communication with the electrically conductive surface. The keypad assembly also includes a plurality of electrical circuits, each of which extend between one contact of the pair of contacts on each of the keys and a predetermined one of a plurality of electrical terminals that are spaced from the electrically conductive surface of the base. The electrical circuits are arranged such that each member of the pair of electrical contacts on one of the keys is in separate electrically conductive communication with a different one of the terminals. Furthermore, the electrical circuits are arranged such that when one of the keys is depressed, electrical communication is established between a preselected pair of electrical terminals that is different for each one of the keys.

Other features of the keypad assembly embodying the present invention include the base of the assembly having an electrically conductive metallic foil disposed on a nonconductive substrate. Another feature includes the base having a plurality of apertures extending between an external surface of the foil and an external surface of the substrate, and a plurality of light-emitting diodes each of which are positioned to direct emitted light through at least one of the apertures.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

The term "keypad assembly" as used herein means a structure having a plurality of separately operable keys and a means for delivering electrical signals to a decoder to determine which of said keys was operated. Such assemblies are typically found on telecommunications instruments which include cellular telephones, mobile radios, personal digital assistants (PDA) and the like, and in other instruments such as control panels, remote controllers, toys, and calculators. In the present invention, the keys may be arranged in any desired configuration, or pattern, without changing the underlying printed wiring board conventionally used to determine which of the keys are actuated.

The present invention reverses the traditional way of designing keypads having rubber pads, or keys, and printed wiring boards (PWB), by putting two conductors for each key on the key itself, and shorting the conductors on a conductive surface provided on the PWB. The interconnection of the circuit identifying which key is actuated takes place on the key itself, so that the interface to the keypad decoding logic does not require change for a different keypad layout or arrangement.

Figure 1:
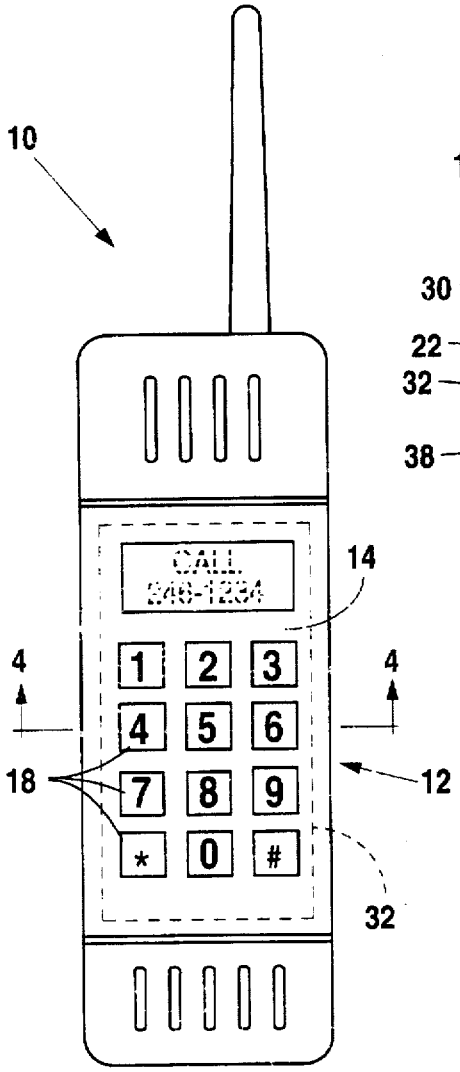
FIG. 1 is a plan view of a telecommunication instrument having a keyboard assembly embodying the present invention.
Figure 4:
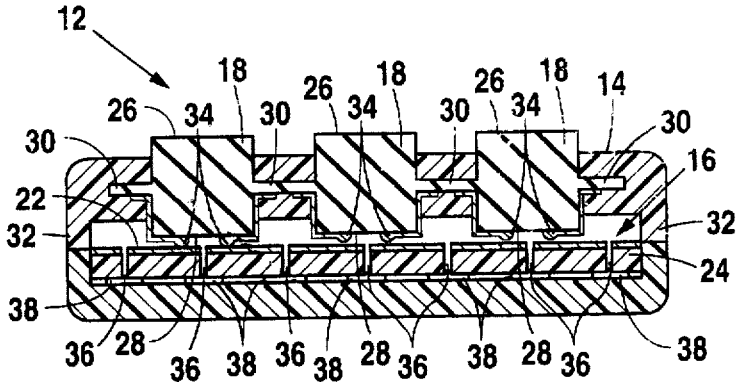
FIG. 4 is a cross-sectional view of the keypad assembly embodying the present invention, taken along the line 4—4 of FIG. 1.
Figure 5:
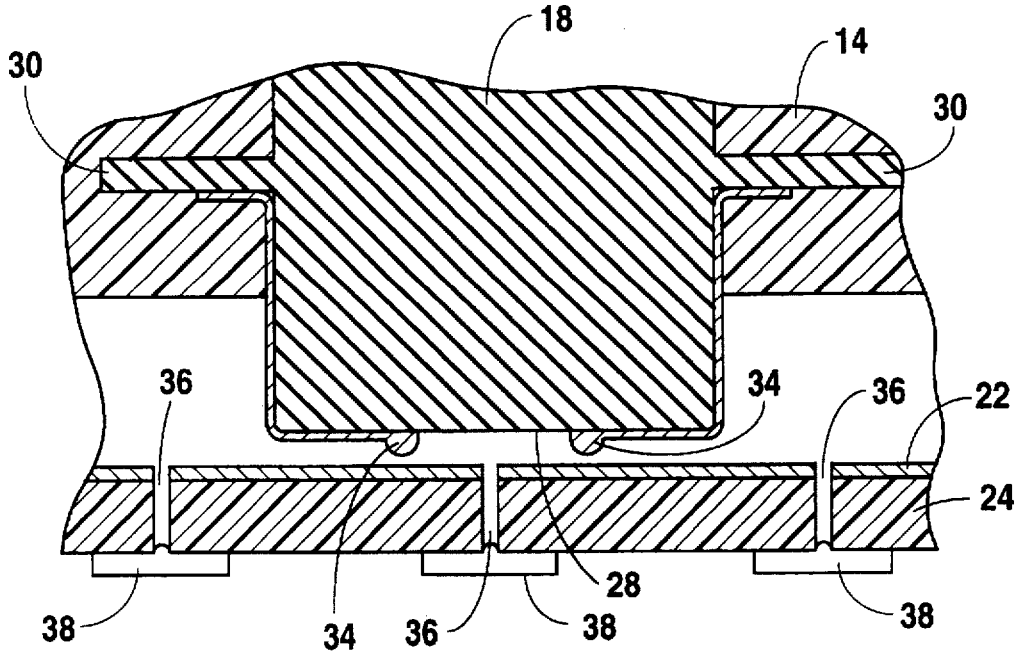
FIG. 5 is an enlarged sectional view of a portion of the keypad assembly embodying the present invention.

In the exemplary preferred embodiment of the present invention, a telecommunication instrument 10 has a keypad assembly 12 that comprises a frame 14, a base member 16 disposed in a fixed relationship with respect to the frame 14, a plurality of keys 18 movably supported in the frame 14, and a plurality of electrical circuits 20. The base member 16 has an electrically conductive surface 22 disposed on a nonconductive substrate 24. Desirably, the base member 16 is a printed wiring board which may have a plurality of internally disposed electrical circuits supporting specific functional operations of the telecommunication instrument 10. The electrically conductive surface 22 disposed on the PWB may advantageously comprise a single large conductor area formed by a sheet of copper foil, or alternatively may be formed by a number of differently-shaped conductor islands. As shown in FIGS. 4 and 5, the electrically conductive surface 22 of the base member 16 is a uniform, planar surface.

Each of the keys 18 have an upper surface 26 that is adapted for tactile contact by an operator of the instrument 10, and a lower surface 28 that is spaced from the upper surface 26. In the exemplary preferred embodiment, the individual keys 18 are interconnected by relatively thin webs 30 that extend between the keys 18 and around the outer periphery of the interconnected key structure. In the illustrated embodiment, the keys 18 are arranged in a conventional twelve-key telephone configuration. An important advantage of the present invention is the ability to change the number and arrangement of the keys 18, for example adding additional function keys or even separate keys for each of the twenty-six letters of the English alphabet, without changing the printed wiring board. Also, the twelve-key arrangement may be arranged in a pattern other than that shown without changing any other components of the instrument 10, except for the keys 18 and the frame 14.

In the preferred embodiment of the present invention, the keys 18 are preferably formed by molding a substantially clear or translucent resiliently compressible material, such as silicone rubber. The light-transmitting properties of clear or translucent materials enables light to be directed through the keys 18 from a source of light in the manner described below. Desirably, a premolded interconnected network of keys 18 and webs 30 is centreliably positioned in a mold cavity, and the frame 14 formed by injection molding around the interconnected key structure, thereby providing a single integral structure comprising the keys and a substantially rigid frame 14. In this construction, the webs 30 are retained in substantially fixed relationship within the frame 14.

The frame 14 is desirably constructed of a conventional thermoplastic or thermoset plastic material having a molding temperature of less than the melting temperature of the keypad material. Suitable materials for the frame 14 include, but are not limited to, ABS resins, cellulosic plastics, phenolic resins, phenylene oxide resins, polycarbonate, polyester, polystyrene, polyurethane, polyvinyl chloride, or blends of such materials.

Importantly, each of the keys 18 has a pair of electrically conductive contacts 34 disposed on the lower surface 28 and are normally spaced from the electrically conductive surface 22 of the base member 16. As best shown in FIG. 4, the frame 14 has a spacing ridge 32 that extends at least partially around the lower peripheral edge of the frame 14 and has a thickness sufficient to assure a controlled clearance between the bottom surface 28 of the keys 18 and the electrically conductive surface 22 of the base member 16. When integrally formed with the frame, the keys 18 are desirably formed of an elastomeric material having sufficient deflection characteristics so that when the top of a key 18 is depressed by a finger, the bottom surface 28 of the key 18 will downwardly. Downward movement of the lower surface 28 of the key 18 causes the electrically conductive contacts 34 to come into physical contact with the electrically conductive surface 22 of the base member 16, resulting in an establishment of an electrical connection between the pair of contacts 34.

Alternatively, the keypad assembly 12 may comprise a plurality of separately formed keys 18. For example, the keys 18 may be spherically-shaped domes, often called Poplars, which pop under contact pressure and deflect the bottom surface 28 of the key 18 downwardly whereby the contacts 34 are brought into electrical contact with the conductive surface 22 on the base member 16. Other materials and constructions of the keys 18 may also be used, including mechanical or spring-biased arrangements, provided that they have an extendable and retractable bottom surface and, desirably, provide a positive tactile feedback to the operator when depressed by the operator's finger.

Figure 2:
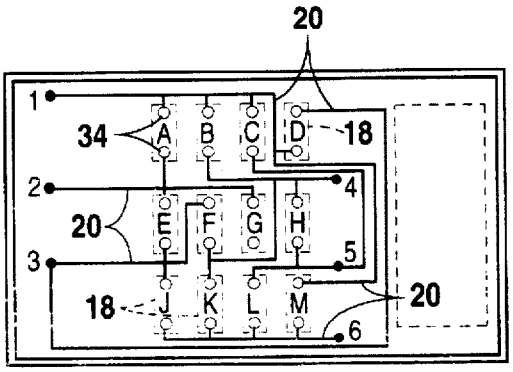
FIG. 2 is a schematic view of the electrical circuits between each of the keys and a preselected terminal, as viewed from the bottom side of the keys.
Figure 3:
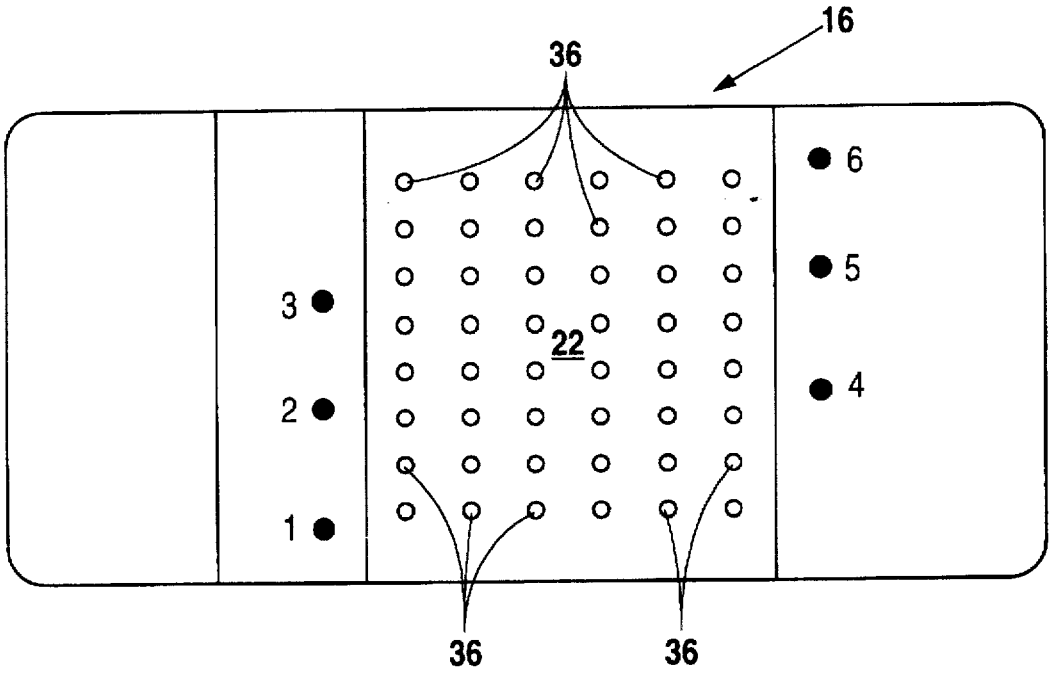
FIG. 3 is a plan view of the base portion of the keypad assembly embodying the present invention.

The electrical circuits 20 are arranged, for example as shown in FIG. 2 wherein the electrical circuits 20 are viewed schematically from beneath the keys 18, to provide electrical communication between each of the contacts 34 disposed on the lower surfaces 28 of each of the keys 18 and a predetermined one of a plurality of electrical terminals, which are identified by numbers 1 through 6 in the schematic drawing. The terminals 1–6 represent interconnection sites between the circuits conductors 20 on the keypad with conductive contacts, or pads, on the printed wiring board, thereby providing connection with the decoding logic circuits of the instrument. Importantly, each member of a pair of contacts 34 on any single one of the keys 18 is in separate electrically conductive communication with a different one of the terminals. The electrical circuits 20 are arranged such that when one of the keys 18 is depressed, electrical communication is established between a preselected pair of the electrical terminals 1–6 such that the preselected pair of terminals 1–6 is different for each of the keys. As shown schematically in FIG. 2, the keys 18, identified by letters of the alphabet, are electrically connected by the circuits 20 to the respective pair of terminals as listed below.

| KEY | TERMINALS |
|---|---|
| A | 1-2 |
| B | 1-4 |
| C | 1-5 |
| D | 1-3 |
| E | 2-3 |
| F | 3-4 |
| G | 2-4 |
| H | 4-5 |
| J | 3-6 |
| K | 4-6 |
| L | 5-6 |
| M | 1-6 |

Thus, it can be seen that upon being depressed, both of the contacts 34 on a key 18 are brought into electrically conductive contact with the surface 22 of the base member 16, and establishes a closed electrical circuit between a discrete pair of the terminals 1–6. It should be noted that the terminal combinations of 2–5, 2–6, and 3–5 are not used in the above layout, permitting the addition of three additional keys without adding additional terminals. The number of keys 18 that can be separately identified by a unique two-terminal combination is represented by the equation:

$$\frac{n!}{2(n-2)!}$$

wherein n equals the number of terminals. Thus, in the illustrated embodiment, six terminals will provide 15 separate combinations whereby each key can be separately identified by the instrument decoding circuitry. In like manner, seven terminals will support 21 keys, eight terminals will support 28 keys, and ten terminals will support 45 keys.

The electrical terminals 1–6 are spaced from the electrically conductive surface 22 of the base member 16 and provide electrical communication between the plurality of electrical circuits 20 disposed on the keypad assembly 12 and a conventional decoding logic chip, not shown, disposed in the internal electrical circuitry of the instrument 10. The electrical circuits 20, may be conveniently formed on the lower surface of the interconnected keys 18 by printing with an electrically conductive ink or formed by etching using a full additive process or subtractive etching, in the manner used in forming printed wiring boards. In the illustrated embodiment, an electrical lead extends from each of the contacts 34 disposed on the lower surface 28 of each of the keys 18, across the adjacent lower surface of the key, then up the side of the key to the web section 30 and thence along the web section to the appropriate terminal 1–6. If desired, selected ones of the electrical leads may extend through the web section 30 and then follow a selected path along the upper surface of the web section to the appropriate terminal 1–6.

Desirably, the keypad assembly 12 includes a means for providing illumination of the keys 18 under low light conditions. In the illustrated embodiment, a plurality of aligned apertures 36 extend between the electrically conductive surface 22 and the external surface of the substrate 14 of the base member 16. The apertures 36 are arranged in a pattern such that at least one of the apertures 36 will be positioned below each of the keys 18 regardless of the configuration or arrangement of the keys. A small fight-emitting diode 38 (LED) is positioned below each of the apertures 36 and provides a source of emitted light through the respective aperture 36. Alternatively, larger LEDs or a single liquid crystal display (LCD) panels may be used to provide a source of light through plural apertures 36.

Therefore, it can be seen that the keypad configuration, number of keys, and arrangement of the keys 18 can be changed for different models of a telecommunication instrument or other keypad-operated device, without changing the printed wiring board and internal circuitry of the instrument. Thus, a single base model of an instrument can be readily adapted for various applications. The keypad assembly 12 described above is also applicable to other keypad-operated instruments such as control panels, remote controllers, toys, calculators, and the like.

Although the present invention is described in terms of a preferred exemplary embodiment, with specific illustrative key constructions and circuit arrangements, those skilled in the art will recognize that changes in those arrangements and constructions, and in the specifically identified materials, may be made without departing from the spirit of the invention. Such changes are intended to fall within the scope of the following claims. Other aspects, features, and advantages of the present invention may be obtained from a study of this disclosure and the drawings, along with the appended claims.

What is claimed is:

1. A keypad assembly, comprising:

a frame;

a base member disposed in fixed relationship with said frame and having a planar electrically conductive surface disposed thereon;

a keypad having defined upper and lower surfaces and supported in said frame in normally spaced, electrically nonconductive relationship with said base member, said keypad comprising a plurality of separately movable keys and interconnecting web portions surrounding each of said keys, said web portions having upper and lower surfaces that are enclosed within portions of said frame and each of said keys having an upper surface adapted for tactile contact by an operator and a lower surface spaced from said upper surface, said lower surface having a pair of spaced apart electrical contacts disposed thereon which are moveable from a first position at which said pair of electrical contacts are spaced from said electrically conductive surface disposed on said base member to a second position at which said pair of electrical contacts are in electrical contact with said electrically conductive surface on the base member in response to depressing the upper surface of the key whereat said pair of electrical contacts are disposed in common electrical communication with said electrically conductive surface;

a plurality of electrical terminals disposed on said keypad in spaced, electrically nonconductive relationship with said electrically conductive surface of the base member;

a plurality of electrical circuits disposed on said keypad, each of which separately extend from one contact of said pair of contacts on the lower surface of each of said keys, and along at least one of said enclosed upper and lower surfaces of the web portion of said keypad to one of said electrical terminals disposed on the keypad in spaced electrically nonconductive relationship with said electrically conductive surface of the base member such that each member of the pair of contacts disposed on one of said keys is in separate electrically conductive communication with a different one of said terminals, said plurality of electrical circuits being arranged such that when one of said keys is depressed, electrical communication is established between a preselected pair of said electrical terminals wherein said preselected pair of terminals is different for each one of said keys.

2. A keypad assembly, as set forth in claim 1, wherein said planar electrically conductive surface of the base member comprises an electrically conductive metallic foil disposed on a nonconductive substrate.

3. A keypad assembly, as set forth in claim 1, wherein said assembly includes a means for illuminating said keys.

4. A keypad assembly, as set forth in claim 1 wherein said planar electrically conductive surface of the base member comprises an electrically conductive foil disposed on a nonconductive substrate, a plurality of apertures extending through said base member and aligned with a respective one of said keys of the keypad, and a plurality of light emitting diodes mounted on said base member, each of said light emitting diodes being positioned to direct emitted light through at least one of said apertures and onto the lower surface of said respective key.

5. A keypad assembly, as set forth in claim 1, wherein said keys are formed of a translucent material.

6. A keypad assembly, as set forth in claim 1, wherein said plurality of keys are formed of a resiliently compressible nonconductive material and are interconnected by web sections extending between adjacently disposed keys and around the periphery of the interconnected keys, said web sections being supported in a substantially fixed position within said frame.

7. A keypad assembly, as set forth in claim 6, wherein said plurality of electrical circuits comprise electrically conductive leads are disposed on said defined lower surface of said keypad.

* * * * *